United States Patent [19]

Boneta

[11] Patent Number: 4,680,880

[45] Date of Patent: Jul. 21, 1987

[54] SNOW PLOW FOR SMALL VEHICLES

[75] Inventor: Louis Boneta, Eagle River, Ak.

[73] Assignee: Moose Industries, Inc., Anchorage, Ak.

[21] Appl. No.: 834,372

[22] Filed: Feb. 28, 1986

[51] Int. Cl.[4] ..... E01H 5/06

[52] U.S. Cl. ..... 37/236; 172/812; 172/819

[58] Field of Search ..... 37/231–232, 37/234–236; 172/810–813, 819

[56] References Cited

U.S. PATENT DOCUMENTS

| | | | |
|---|---|---|---|
| 2,694,267 | 11/1954 | Donnelly et al. | 37/236 |
| 2,867,921 | 1/1959 | Brown | 37/236 |
| 3,214,138 | 10/1965 | Jocher et al. | 37/236 |
| 3,422,553 | 1/1969 | Holloway | 37/232 |
| 3,432,949 | 3/1969 | Glesmann | 37/236 |
| 3,483,641 | 12/1969 | Hirt | 37/236 |
| 3,659,362 | 5/1972 | Bell | 37/236 |
| 4,244,122 | 1/1981 | Hetrick | 37/236 |
| 4,279,084 | 7/1981 | Low et al. | 37/236 |
| 4,304,056 | 12/1981 | Watson et al. | 37/232 |
| 4,320,589 | 3/1982 | Pelazza | 37/236 |
| 4,439,939 | 4/1984 | Blau | 37/231 |
| 4,528,762 | 7/1985 | Sarka et al. | 37/236 |

*Primary Examiner*—E. H. Eickholt

*Attorney, Agent, or Firm*—Michael J. Tavella

[57] ABSTRACT

A snow plow, designed to fit on small vehicles, is disclosed. The plow has a single point connection to the vehicle. A novel yoke mounting scheme is also disclosed, which enables the blade to be angled. The plow is operated by a pneumatic means, controlled from within the vehicle. All operating connections to the vehicle are made through a single power cord. All pneumatic lines are self contained within the plow, thereby eliminating the need for air hoses to be connected or installed on the vehicle. The plow has an upstop device that is used to block upward travel of the plow. The upstop is used to prevent the plow from obscuring the headlights of the vehicle. An uplock is also provided which acts to lock the plow blade in an non-operating position when the plow is not needed, thereby preventing the possibility of the blade dropping to the road and causing an accident. The plow is designed to be removed quickly and easily from the vehicle for storage.

10 Claims, 9 Drawing Figures

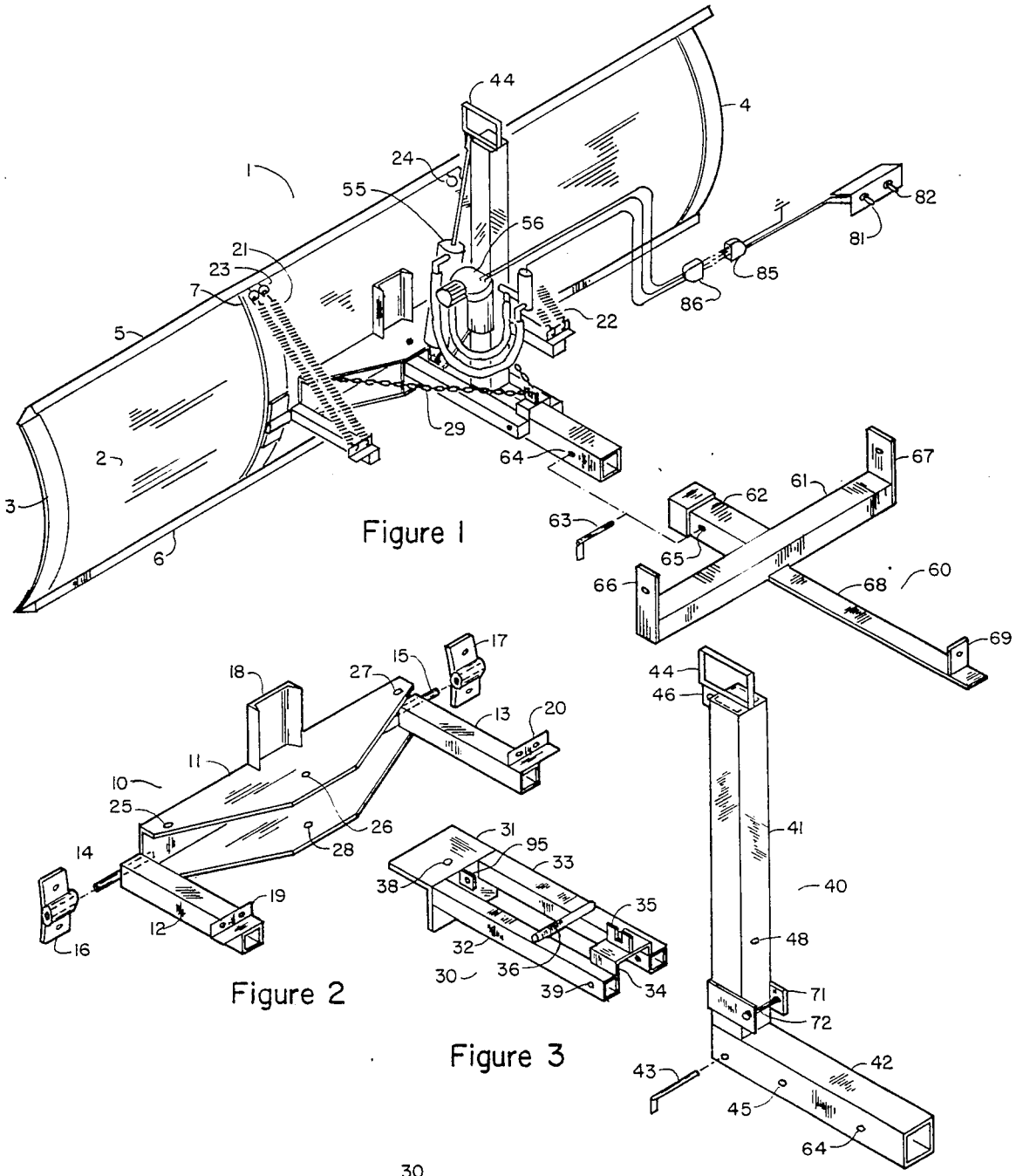
Figure 1
Figure 2
Figure 3
Figure 4
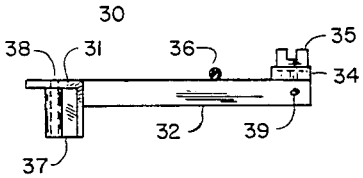
Figure 5
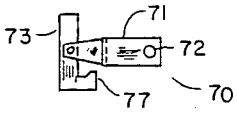
Figure 6

SNOW PLOW FOR SMALL VEHICLES

BACKGROUND OF THE INVENTION

This invention is related to snow plows; and more particulary, to pneumatic, plows for small vehicles.

Over time, a number of devices have been developed to plow snow from roads, driveways, and parking lots. These designs, typically large, heavy and cumbersome are designed for big trucks and pick-up trucks. Examples of this type of plow can be found in U.S. Pat. Nos. 3,483,641, 4,439,939, 2,694,267, 4,304,056, 2,867,921, and 3,214,138.

In the 1970's a number of factors produced a smaller size vehicle--the sub-compact cars and trucks. The size of these vehicles was such that existing plows couldn't be used with them, although for light plowing jobs i.e. driveways, sidewalks or small confined areas, these vehicles are ideal.

The problem of reducing the large plows to fit the smaller plows is two fold: First, the vehicles lack the heavy suspensions and extra weight of their larger counterparts; they also lack adequate room for extra batteries, larger alternators and the hydraulic systems commonly found in the case of larger plows. Second, the plows themselves cannot simply be shrunk down to fit these smaller cars. In effect, the plows have to be redesigned to do the job on a simpler level.

It is an object of this invention to produce a lightweight snow plow for use with small vehicles. A second object of the invention is to develop a new mounting system to provide proper distribution of the many forces on a snow plow blade that utilizes a new mounting system consisting primarily of a yoke arrangement that is connected to a swing arm assembly that makes a single point connection to the vehicle.

Another object of the present invention is the use of an upstop device that prevents the plow blade from rising too high, thereby obscuring the headlights of the vehicle. As yet another object of the invention is the provision of an uplock device that is used to secure the blade in a raised position and to keep it in that position when not in use. The uplock will prevent the blade from dropping to the ground when the vehicle is being driven, which could pose to be a serious hazard to the vehicles and other vehicle on the road.

Finally, another object of the invention is the provision of a simple means to angle the blade when necessary.

BRIEF DESCRIPTION OF THE INVENTION

The invention consists of a removable snow plow that is used on small vehicles. The plow can be used on either a light pick-up truck or a compact car. Unlike other vehicular mounted plows, this plow is designed to be easily removed and installed by one person. There is only one mechanical, and one electrical connection to the vehicle. The plow has all of the operating parts mounted to it so there is no need to install a separate compressor and air tank, or hydraulic system within the vehicle.

The device comprises an aluminum plow blade that is curved to enable it to plow snow more efficiently. Aluminum plates are welded to the rear of the outer edges and along the rear bottom edge of the blade to stiffen it sufficiently for use. the blade also has two steel mounting brackets that are positioned to accept a mounting yoke.

A mounting yoke is fastened to the blade with a pin and bushing arrangement. The mounting yoke has provisions for two pairs of springs which fasten to the blade to act as shock absorbers. The mounting yoke also has mounting holes for a blade angle adjusting chain, which in turn is fastened to the swing arms.

The swing arms consist of an angle iron and two pieces of square tubing, that extend purpendicularly outward from the angle iron. A stiffener bracket is mounted at the rear of the tubing to maintain spacing. This bracket is also used to secure the blade angle adjusting chain, which is attached to the blade mounting yoke. The chain is used to position the blade for angled plowing. The blade is turned to the proper position and then the chain is simply dropped into a slot provided on top of the stiffener bracket to hold the desired angle.

A pedestal consisting of two pieces of square tubing, mounted at right angles is also included. The vertical tube is sealed at the ends, forming a tank to store the compressed air under pressure. The second tube extends horizontally from the tank and acts as the plow mounting arm. This arm is inserted into the hitch recepticle mounted on the vehicle.

A small, electrically driven, compressor is mounted to the tank. A solenoid valve is also mounted on the tank. The output of the tank is supplied to the air ram through the solenoid valve utilizing hoses. The air ram is connected between the air tank and the swing arm assembly. The air ram provides power for the up and down movement of the plow.

The pedestal is mounted to the swing arm assembly by a single pin which passes through the swing arms and the pedestal. This single connection point allows the swing arm assembly, which is fastened to the blade, to pivot up and down as needed. This entire assembly can be easily removed and installed on the vehicle.

The solenoid valve, compressor, and uplock solenoid are controlled by the switches mounted in the vehicle. The switch wiring terminates in a female plug assembly that is mounted near the front of the vehicle. The compressor, valve, and uplock solenoid wiring are terminated in a male plug assembly, which is fixed to the plow. Once the plow is installed on the vehicle, the operator simply plugs in the system to energize it.

A solenoid operated upstop/uplock is provided. This consists of a bracket, latch, solenoid and spring assembly. The upstop is used to prevent the blade from rising too far, thereby blocking the headlights of the vehicle. This not only provides a measure of safety, it also eliminates the need for additional sets of headlights commonly used with other snow plow designs, thereby allowing the same plow to be used on many different sized vehicles.

The uplock feature is used to secure the plow at a height safe for driving. Without the lock, it is possible, under certain conditions, for the plow to drop to the ground. This could be extremely hazardous if the vehicle is moving at a high rate of speed. With the uplock in place, however, this possibility is greatly reduced.

BRIEF DESCRIPTION OF THE DRAWINGS

FIG. 1 is a perspective view of the invention.

FIG. 2 is an exploded detail view of the blade yoke assembly.

FIG. 3 is a detail view of the swing arm assembly.

FIG. 4 is a detail view of the pedestal assembly.

FIG. 5 is a side view detail of the swing arm assembly.

FIG. 6 is a side view detail of the uplock bracket for manual operation.

DETAILED DESCRIPTION OF THE INVENTION

Figure 8:
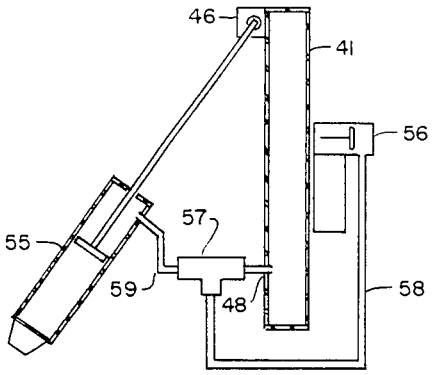
FIG. 8 is a schematic diagram of the pneumatic system of the invention.

Referring now to the drawings, and more particularly to FIG. 1, the invention comprises a snow plow 1 that is designed to be mounted to the vehicle at one point. The snow plow 1 is constructed of several sub assemblies. The first is the blade 2. The blade 2 is made of lightweight metal, preferably aluminum. Plastic, PVC and other, lightweight, non-metallic materials can be used also. The blade 2 is curved to provde a proper surface for plowing. In the preferred embodiment, the height of the blade is 18 inches. This not only allows the blade to plow through substantial amounts of snow, it also does not cover the vehicle's headlamps when the blade 2 is in the up position. The blade 2 is stiffened around its perimeter with 2 vertical stiffeners 3 and 4, and a horizontal stiffener 6. The top edge 5 of the blade 2 provides additional stiffening, without additional metal. Two support braces 7 and 8 (note, 8 is hidden behind the pedestal 40 but is essentially constructed in the same manner as 7), are positioned as shown and act to receive the blade mounting yoke pins 14 and 15, thus securing the blade mounting yoke 10. This arrangement allows for the easy removal of the blade for maintenance.

Referring now to FIG. 2, the blade mounting yoke 10 is made from angle iron and tubing. The mounting bracket 11 is formed as shown. Two pieces of tubing are used to form the spring extensions 12 and 13, which are welded into place within the mounting bracket 11. Two blade mounting pins 14 and 15 are mounted on the ends of the extensions when they are welded into place. The pins 14 and 15 are inserted into brackets 16 and 17. The brackets 16 and 17 are bolted onto the support braces, 7 and 8, on the blade (see FIG. 1). The brackets 16 and 17 are bolted into place so that they can be removed to allow for blade replacement.

A center blade return stop 18 is welded to the top of the mounting bracket 11 as shown.

Two spring support brackets 19 and 20 are mounted at the rear of the spring extensions 12 and 13. Two pairs of springs 21 and 22 (note: each number represents two springs, two connecters, etc.) are mounted between the spring support brackets 19 and 20 as shown. The springs extend to the blade 2 and are fastened at points 23 and 24 with eye bolts.

Referring now to FIGS. 3, 4 and 5, the swing arm assembly 30 consists of a front angle iron 31 positioned as shown. Two square tubing pieces 32 and 33 are fastened to the angle also as shown. The tubing pieces are welded or otherwise secured by known methods in the art. A spacer bracket 34 is positioned at the rear of the tubes 32 and 33 as shown. Its function is to maintain the spacing of the tubes 32 and 33 and to act as a mount for the chain adjusting slot. The bracket 34 is welded to the tubing as shown. The control chain 29 is used to maintain the angle of the blade 2 once it has been set manually. The chain 29 is connected to holes 25 and 27 on the blade mounting yoke 11. It is then passed through the chain slot 35 on the swing arm assembly 30. The use of the chain 29 will be discussed in greater detail below.

A locking bar 36 is also provided on the swing arm assembly 30. The use of this bar will also be discussed below.

The swing arm assembly 30 is connected to the blade mounting yoke 11 by sliding the angle portion 31 into the space of the yoke 11 until hole 38 is aligned with the holes 26 and 28 on the yoke 11. Note that FIG. 5 shows a spacer pipe 37, which is fastened to the angle 31. A bolt (not shown) is then passed through the yoke at hole 26, through the angle 31 at hole 38, through the spacer 37 and finally, through hole 28 in the bottom of the yoke 11. The bolt is then fastened with a locknut.

Referring now to FIG. 4, the plow has a self contained air tank assembly or pedestal 40. The pedestal has a vertical portion 41 that is used as an air tank. The tank is built of square tubing. Both ends of the tank 41 are sealed with welded plates, thereby forming an air tight cavity. The lower portion of the pedestal 40 forms the plow mounting arm 42. The plow mounting arm 42 is used to connect the entire plow assembly to the vehicle at the frame assembly 60. The plow mounting arm 42 is also used to fasten the pedestal 40 to the swing arm assembly 30 at hole 45. The tank is connected to the swing arm assembly at point 39, using pin 43. This allows the tank to act as a pivot point for the blade when it is raised or lowered (this action is caused by the air ram discussed below). The pedestal 40 is also fitted with a handle 44, which is welded to the top of the tank portion 41. This handle 44 is used in installing and removing the blade assembly.

A standard lightweight air ram cylinder 55 is attached to the pedestal 40, as shown in FIGS. 1 and 4, at the bracket 46. The cylinder 55 is then connected to the swing arm assembly 30 at bracket 95. The cylinder 55 is then able to lift or lower the entire blade assembly, once the pedestal assembly 40 is firmly attached to the vehicle.

Another novel feature of this plow, is that the air compressor and control valve are attached to the pedestal 40. This eliminates the need for air lines running from the vehicle to the plow. It also eliminates the need to modify the vehicle with compressors and valves and hoses.

Referring now to FIG. 1, the compressor 56 is attached to the side of the pedestal 40 as shown. The location of the compressor should be chosen in view of the need to run connecting hoses 58 between the compressor 56, the control valve 57 and the air ram 55. An electricly operated solenoid valve 57 is used in the preferred embodiment to control air flow from the tank and compressor. The valve 57 is connected to the air tank at hole 48 (see FIG. 4), which taps into the tank 41. This tap must be sealed to prevent air loss. The connecting hoses 58 are run as shown in the schematic connecting diagram (FIG. 8). This is a standard routing arrangement, which utilizes standard connecting fittings as needed to make the connections. The electrical controls for the compressor 56 and the valve 57 are discussed below.

The entire blade assembly 1 is connected to the vehicle at the frame means 60. The frame 60 consists of a squared tubing "T" frame 61 as shown. The plow mounting arm 42 of the pedestal 40 is inserted into the front end of the frame assembly 60 at point 62. The blade assembly is secured to the frame assembly with a pin 63, which is inserted into both the frame 60 at point 65 and the connector portion 42 at point 64.

The frame assembly 60 is fastened to the vehicle with the straps 66 and 67. These straps bolt to either existing brackets (not shown), or to those added to the vehicle. A rear strap 68 is also used to provide additional support. This strap is attached to the vehicle with strap 69, which also bolts into place.

A novel feature of this invention is the combination upstop/uplock device. Referring to FIGS. 4, 5 and 6, the uplock/upstop device 70 consists of a clamp portion 71 which is formed from steel channel. The clamp 71 is designed to fit around the pedestal 40. The clamp is held tightly to the tank by means of a bolt 72 and nut. This bolt will compress the clamp 71 around the pedestal and hold it in a fixed position. The bolt 72 also allows the clamp to be moved up and down the tank as needed to adjust the stop height of the blade and to set the upper limit of travel. For use as an upstop, the clamp is positioned at a level that prevents the blade form rising past the level of the headlamps of the vehicle. If the blade blocked the headlamps, it could produce a hazardous driving condition. The upstop works by blocking the upward movement to the swing arm assembly 30. This occurs when the tubing pieces, 32 and 33, on the swing arm assembly contact the clamp 71. Clamp 71 simply blocks any further upward movement of the released assembly, and, therefore, the blade.

The uplock device is used to ensure the safety of the vehicle when the blade is not in use. Typically, most blades are held up by hydraulic or pneumatic pressure. If the hydraulic system failed, the blade would drop to the road bed. If this occurs when the vehicle is in motion, at highway speeds, it could cause serious damage.

Figure 6A:
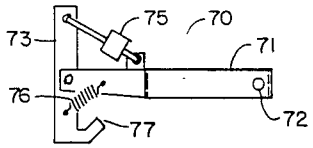
FIG. 6*a* is a side view detail of the uplock bracket for automatic operation.
Figure 7:
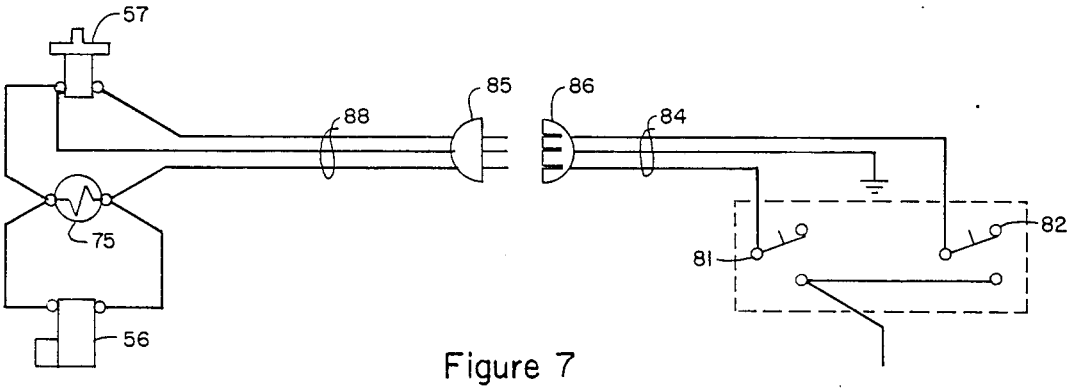
FIG. 7 is a schematic diagram of the electrical control wiring.

Referring now to FIGS. 6 and 6*a*, two different uplocks are disclosed. The first is a manually operated device. To operate the uplock, the latch 73 is pivoted outward from the pedestal. The swing arm assembly 30 is then raised unti the holding bar 36 is above the latch jaw 77. The latch is then pivoted back until the latch jaw 77 is under the holding bar. The swing arm assembly 30 is then lowered until the holding bar is securely held by the latch 73.

A second uplock is also disclosed. This uplock is controlled by a solenoid. The powered uplock is activated by the uplock solenoid 75, which acts to automatically pivot the latch 73 in the same manner as that of the manual device. The uplock is also provided with a spring 76 that will set the uplock in the latch position when the power to the solenoid is removed. The weight of the plow will be applied to the jaw 77 of the latch 73, thereby preventing the plow from dropping. In order to release the latch 73 and free the plow, the compressor switch must be turned on, which will activate both the compressor and the latch solenoid 75. As long as the weight of the plow is on the latch jaw 77, the solenoid 76 will not pull up the latch 73. Once the plow switch is placed in the up position, air pressure is applied to the ram which will raise the plow. After the blade is raised approximately ½", the latch 73 will be released and the solenoid will pull up the latch 73 into the operating position. The device is designed to hold the latch 73 open during use of the plow. To activate the latch, both the compressor switch and the plow switch must be placed in the down (off) position simultaneously. This will release the latch 73 immediately, while the plow is dropped down over a 3 to 5 second delay as air is bled from the air ram.

Referring now to FIGS. 1 and 8, the compressor 56, the uplock solenoid 75, and solenoid valve 57 are controlled from inside the cab of the vehicle by two switches, 81 and 82, which are mounted on a panel 83. One switch activates the compressor 56 and the uplock solenoid 75, and the other activates the valve 57. The wiring of the switches is shown in schematic form in FIG. 8. Mechanically, the switch wiring 84 is run out to the front of the vehicle and is terminated with a standard 3 prong, female grounding plug 86. A male plug portion 85 is attached to the compressor/valve wiring 88, which is installed on the plow. This arrangement allows the plow to be removed from the vehicle in three steps: First, the compressor and valve are disconnected at plug 86 - 87, second, the pin 63 is removed from the frame member 60, and finally, the plow is pulled out of the frame, using the handle 44 for assistance.

It is intended that the present disclosure should not be construed in any limited sense other than that limited by the scope of the following claims having regard to the teachings herein and the prior art being apparent with the preferred form of the invention disclosed herein and which reveals detail of structure of a preferred form necessary for a better understanding of the invention and may be subject to modification by skilled persons within the scope of the invention without departing from the concept thereof.

I claim:

1. A snow plow comprising:

A. a blade;

B. frame means for attaching said snow plow to said vehicle;

C. a mounting yoke fixedly attached to said blade;

D. a swing arm removably attached to said mounting yoke, thereby forming an integral assembly with the blade and mounting yoke;

E. a pedestal, said pedestal having a vertical component and a horizontal component, said vertical component forming a compressed air storage tank, said horizontal component being purpendicularly connected to said vertical component and having a first set of connecting holes therein being used to removably attach said pedestal to said swing arm, and a second set of connecting holes being used to attach said pedestal to said frame means;

F. pneumatic lifting means fixedly attached to swing arm such that said lifting means act to pivotably raise or lower said swing arm, and therefore, the blade, longitudinally about the pedestal;

G. compressor means attached to said pedestal;

H. valve means connected to said pedestal to permit proper flow of air to the pneumatic lifting means;

I. control means to operate said compressor and valve means.

2. the snow plow of claim 1 further comprising:

A. upstop means, adjustably attached to said pedestal such that said swing arm contacts said upstop means at a predetermined position of said swing arm when said swing arm is raised, thereby stoping the upward movement of said swing arm.

3. The snow plow of claim 2 wherein said upstop means comprises:

A. a clamp, slidably attached to said pedestal having at least one contact extension, and;

B. a contact bar fixedly attached to said swing arm, said contact bar being placed on said swing arm such that said contact bar contacts said extension on said clamp when the desired upward limit of travel is reached.

4. The snow plow of claim 2 further comprising:

A. uplock means, adjustably attached to said pedestal having latch means to secure the swing arm in an elevated position for travel.

5. The snow plow of claim 4 wherein the uplock means comprise:

A. a clamp, slidably attached to said pedestal;

B. and said latch means further comprises a latch, pivotably connected to said clamp; and C. a holding bar, fixedly connected to said swing arm such that said latch contacts said holding bar, thereby securing said swing arm in an elevated position, thus preventing downward movement of the swing arm.

6. The snow plow of claim 5 further comprising:

A. solenoid means including a solenoid, fixedly attached to said clamp and said latch such that when the plow is activated, the solenoid pivots the latch, thereby releasing the swing arm holding bar; and B. spring means, fixedly attached to said latch and said clamp such that when the solenoid means are de-energized, said latch will be pivoted into a locking position with respect to the holding bar, thereby securing said swing arm.

7. The device of claim 1 further comprising angling means, attached to said frame means and said blade that sets the blade at an angle, with respect to its normal operating position, and maintains the blade at that angle until the angling means are released.

8. The device of claim 7 wherein said angling means comprise a chain, fixedly attached to said blade at two points of opposite displacement, and latching means fixedly conencted to said frame means to secure said chain, such that the chain may be pulled to shorten the length to one side of the blade thereby causing the blade to be pulled in that direction and thereby setting the blade at an angle, and then said latching means locking said chain in that position until said latching means is released.

9. The device of claim 6 further comprising angling means, attached to said frame means and said blade that sets the blade at an angle, with respect to its normal operating position, and maintains the blade at that angle until the angling means are released.

10. The device of claim 9 wherein said angling means comprise a chain, fixedly attached to said blade at two points, and latching means fixedly connected to said frame means to secure said chain, such that the chain may be pulled to shorten the length to one side of the blade thereby causing the blade to be pulled in that direction and thereby setting the blade at an angle, and then said latching means locking said chain in that position until said latching means is released.

* * * * *